US005505552A

United States Patent [19]

Hasegawa et al.

[11] Patent Number: 5,505,552

[45] Date of Patent: Apr. 9, 1996

[54] CUTTER DEVICE OF A PRINTER

[75] Inventors: Kazumi Hasegawa, Tokyo; Makoto Kawasaki, Saitama, both of Japan

[73] Assignee: Citizen Watch Co., Ltd., Tokyo, Japan

[21] Appl. No.: 365,481

[22] Filed: Dec. 28, 1994

[30] Foreign Application Priority Data

Dec. 28, 1993 [JP] Japan ..... 5-349476

[51] Int. Cl.[6] ..... B41J 3/24

[52] U.S. Cl. ..... 400/621; 101/93.07; 83/879; 83/881

[58] Field of Search ..... 400/621, 621.2; 83/49, 582, 862, 879, 880, 881, 882; 101/93.07

[56] References Cited

U.S. PATENT DOCUMENTS 4,211,498 7/1980 Shimizu et al. ..... 400/621

FOREIGN PATENT DOCUMENTS 56-67997 6/1981 Japan .
2-44054 3/1990 Japan .
026493 2/1991 Japan ..... 83/879
3-79298 4/1991 Japan .
142957 5/1992 Japan ..... 400/621
4-365593 12/1992 Japan .
5-200693 8/1993 Japan .

*Primary Examiner*—Ren Yan
*Attorney, Agent, or Firm*—Lowe, Price, LeBlanc & Becker

[57] ABSTRACT

A cutter device includes, in addition to one solenoid 17, two pairs of assemblies disposed in parallel with each other in a direction of movement of a cutter 2, the first pair having a rack 5, a pinion 10, and a clutch 49 to control rotation of the pinion, and the second pair having another rack 6, another pinion 11, and another clutch 50 to control rotation of the pinion. In partial-cutting operation, the cutter 2 is moved by engaging the rack 5 in the first pair with the pinion 10 in the first pair rotated through power from the clutch 49 in the first pair. In full-cutting operation, the cutter 2 is moved by engaging the pinions 10,11 in the first and second pairs concurrently rotated through power from the clutches 49,50 in the first and second pairs with the racks 5,6 in the first and second pairs. The pinion 10 in the first pair causes the full-cutting first half movement of the cutter, and the pinion 11 in the second pair causes the full-cutting latter half movement thereof.

1 Claim, 8 Drawing Sheets

CUTTER DEVICE OF A PRINTER

BACKGROUND OF THE INVENTION

1. Field of the Invention

This invention relates to a cutter device to, for example, fully or partially cut a paper selectively.

2. Description of the Related Art

As disclosed in Japanese Patent Laid-open No. 465593, there has been provided one cutter device to fully or partially cut a paper selectively, including a cutter cam, a cutter lever, a switching member, and switching/driving means. The cutter cam having an eccentric shaft is rotated by a driving mechanism. The cutter lever is mounted about a supporting point so as to enable reciprocating rotation thereof. Further, one end of the cutter lever is provided with an engaging hole into which the eccentric shaft of the cutter cam is fitted with a gap, and the other end thereof is connected with a cutter. The switching member has an engaging portion which is mounted removably between a wall surface of the engaging hole in the cutter lever on the side of a direction of the rotation and the eccentric shaft. The switching/driving means moves and drives the engaging portion of the switching member in directions of insertion and removal. In the cutter device, the engaging portion of the switching member is inserted into or removed from the engaging hole in the cutter lever for switching of moving strokes of the cutter with respect to the paper, thereby carrying out full-cutting operation or stabbing operation, that is, perforating operation.

However, in addition to the switching/driving means for driving the switching member to carry out switching of the full-cutting operation and the partial-cutting operation, the cutter device requires cutter lever driving means for reciprocating the cutter lever connected with the cutter. Therefore, it is necessary to ensure a mounting space for the cutter lever driving means, thereby requiring additional production cost of the space.

OBJECTS AND SUMMARY OF THE INVENTION

It is an object of the present invention to provide a cutter device which can drive a cutter without special cutter driving means for driving the cutter, control switching between full- cutting operation and partial-cutting operation by one solenoid, reduce production cost and realize the space saving.

The present invention can be summarized as follows:

In a cutter device, a first cutter driving structure and a second cutter driving structure are disposed in parallel with each other in a direction of movement of a cutter. The first cutter driving structure includes a first rack, a first pinion, and a first clutch to control rotation of the first pinion, and the second cutter driving structure includes a second rack, a second pinion, and a second clutch to control rotation of the second pinion.

The first pinion has teeth whose number is sufficient to carry out only the partial-cutting operation, and engages the first rack controlled by the first clutch to move the cutter forward from an initial retracted position by a first distance. The first distance is required for the partial-cutting operation of the cutter.

The second pinion has teeth whose number is given by subtracting the number of teeth of the first pinion from the number of teeth required to carry out the full-cutting operation. The cutter is held forward moved by the first cutter driving structure by the first distance, and the second pinion engages the cutter with the second rack controlled by the second clutch to move the cutter further ahead of the position by a second distance. In this case, the first distance can serve as a first half moving distance for the full-cutting operation, and the second distance can serve as a latter half moving distance for the full-cutting operation.

The first clutch serves to stop the rotated first pinion at its initial position.

The second clutch serves to stop the rotated second pinion at two positions, that is, at its initial position and at a second position different from the initial position.

Thus, when both the first pinion and the second pinion are stopped at their initial positions, one solenoid is operated for a short period of time to disengage the first and second clutches so as to concurrently rotate the first pinion and the second pinion.

If the solenoid is not operated once again for a short period of time immediately after the above operation, only the second pinion is stopped at the second position, and the rotated first pinion can engage the first rack to feed the cutter by the first distance (the partial-cutting operation).

If the solenoid is operated once again for a short period of time immediately after the beginning of the concurrent rotation of the first pinion and the second pinion, the second pinion is not stopped at the second position, resulting in continued rotation of the second pinion. Further, the first pinion engages the first rack to move the cutter forward by the first distance, thereby starting disengagement between the first pinion and the first rack and starting engagement between the second pinion and the second rack. As a result, the cutter is moved further ahead of the position by the second distance (the full-cutting operation).

DETAILED DESCRIPTION OF THE PREFERRED EMBODIMENTS

Preferred embodiments of the invention is described bellow with reference to the drawings.

Figure 1:
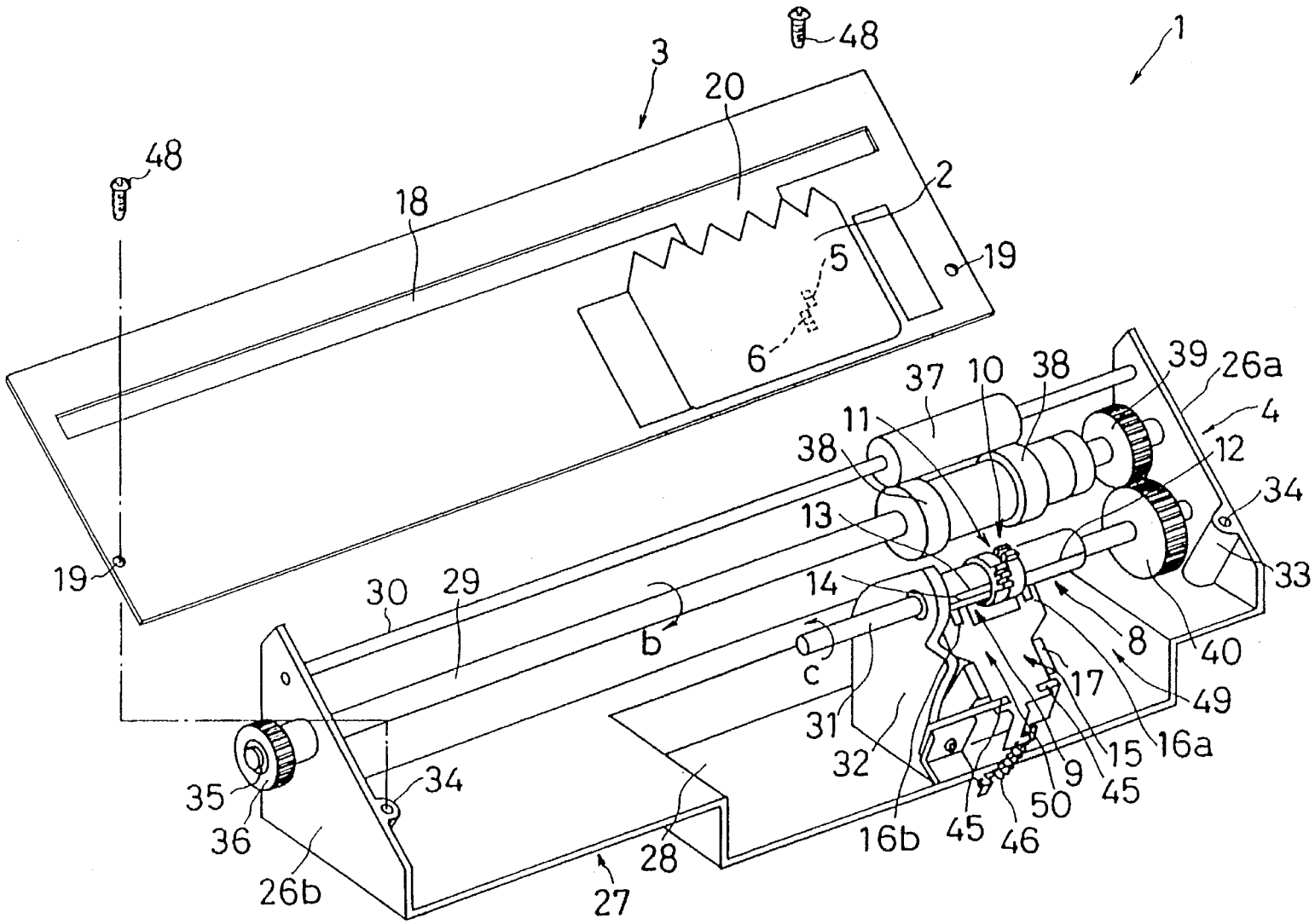
FIG. 1 is an exploded perspective view of one embodiment of a cutter device of the present invention.

FIG. 1 is a perspective view of one embodiment of a cutter device. Schematically, a cutter device 1 is provided with one pair for partial-cutting/full-cutting first half movement, and the other pair for full-cutting latter half movement. In the former pair, a first rack 5, a first pinion 10, and a first clutch 49 to control rotation of the first pinion 10 are disposed in parallel therewith along a direction of movement of a cutter 2. In the latter pair, a second rack 6, a second pinion 11, and a second clutch 50 to control rotation of the second pinion 11 are disposed in parallel therewith along the direction of movement of the cutter 2. Further, the cutter device has one solenoid 17 in addition to the two pairs.

The cutter device 1 includes a cutter mounting plate 3 having the cutter 2 to cut a paper, and a cutter device body 4 in which the two pairs of assemblies are disposed in parallel with each other along paper feed rollers 38 or the direction of movement of the cutter 2. The assemblies include the first and second pinions 10 and 11, and the first and second clutches 49 and 50 to control the rotation of the pinions 10 and 11, and the solenoid 17 is also mounted.

Figure 2:
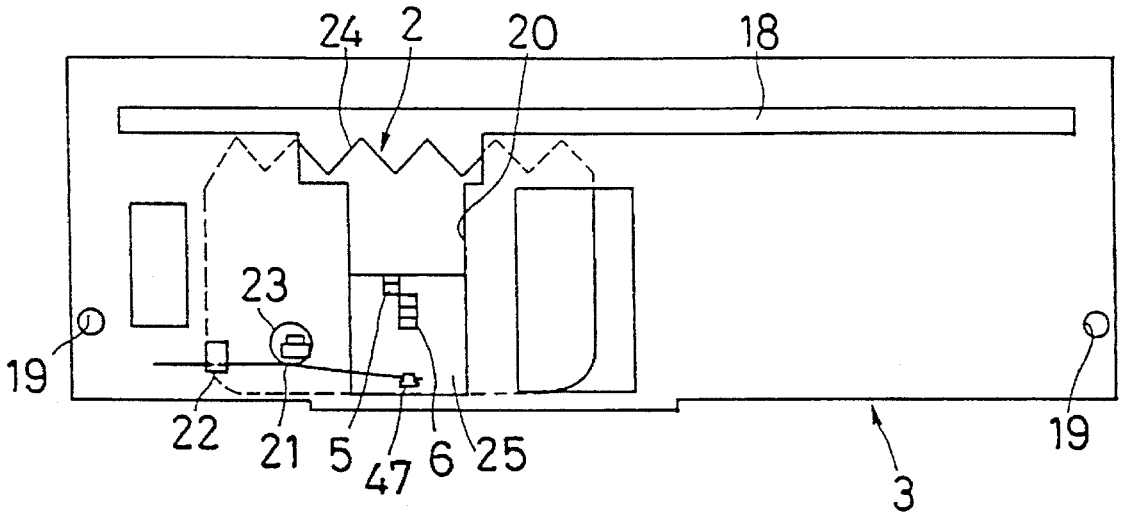
FIG. 2 is a back view of a cutter mounting plate.

A paper ejecting port 18 is provided in the cutter mounting plate 3 at a position closer to one side thereof in a width direction, and extends to have a long distance in a longitudinal direction. Mounting holes 19 are provided in the cutter mounting plate 3 at both the ends. As shown in FIG. 2, a substantially rectangular cutter guide hole 20 is provided in the cutter mounting plate 3 to extend from a position closer to the other end thereof in the width direction so as to be communicated with the paper ejecting port 18.

On a back surface of the cutter mounting plate 3, as shown in FIG. 2, a spring fitting projection 21 and a spring engaging projection 22 are integrally formed with the cutter mounting plate 3 on the one side of the cutter guide hole 20. A torsion coil spring 23 is mounted about the spring fitting projection 21, and one end of the torsion coil spring 23 engages the spring engaging projection 22.

The cutter 2 includes a thin metallic plate, and triangular cutting edges 24 are formed at a distal end of the cutter 2. Further, the cutter 2 is mounted on an upper surface of the cutter mounting plate 3 such that the cutting edges 24 are movable toward or opposite to the paper ejecting port 18 provided in the cutter mounting plate 3.

A cutter guide plate 25 is integrally formed with the cutter 2 in a range from an intermediate portion to a rear end of a lower surface of the cutter 2. As shown in FIG. 2, the cutter guide plate 25 has a width which is slightly smaller than that of the cutter guide hole 20 provided in the cutter mounting plate 3. The cutter 2 is supported by its both sides contacting the upper surface of the cutter mounting plate 3, and the cutter guide plate 25 is fitted into the cutter guide hole 20 while directing its surface downward.

The first rack 5 for partial-cutting/full-cutting first half movement, and the second rack 6 for full-cutting latter half movement are adjacently disposed on the distal end side of the surface of the cutter guide plate 25.

Teeth of the first rack 5 are disposed ahead of teeth of the second rack 6 in the direction of movement of the cutter 2. Further, a spring engaging projection 47 is integrally formed on the rear end side of the surface of the cutter guide plate 25. The spring engaging projection 47 engages the other end of the torsion coil spring 23 which is mounted about the spring fitting projection 21 extending from a back surface of the cutter mounting plate 3, thereby urging the cutter 2 toward the rear end side opposed to the paper ejecting port 18.

As shown in FIG. 1, the cutter device body 4 includes substantially triangular both side plates **26*a* and 26*b*, and a bottom plate portion 27 in which a concave portion 28 is provided at a substantially intermediate portion thereof. A rotation transmitting shaft 29 and a roller shaft 30 are pivotally supported between both the side plates 26*a* and 26*b*. Torque is transmitted from an unillustrated printer body to the rotation transmitting shaft 29. Further, an intermediate plate 32 stands in the concave portion 28 of the bottom plate portion 27, and a rotary shaft 31 is pivotally supported between the intermediate plate 32 and the one side plate 26*a* to receive torque from the rotation transmitting shaft 29. Half-cylindrically expanded portions 33 respectively extend from end surfaces of oblique sides of both the substantially triangular side plates 26*a* and 26*b* toward inner surfaces of the side plates. Then, tap holes 34*a* and 34*b* are respectively provided in the expanded portions 33 to mount the cutter mounting plate 3**.

The rotation transmitting shaft 29 passes through the other side plate **26*b*, and a gear 36 is mounted together with an E-ring 35 at a distal end of the rotation transmitting shaft 29 passing through and outwardly extending from the other side plate 26*b*. The gear 36 meshes with transmitting means including a train of gears linked with a driving motor of the unillustrated printer body, to be rotated in a direction shown by the arrow b in FIG. 1**.

Figure 4:
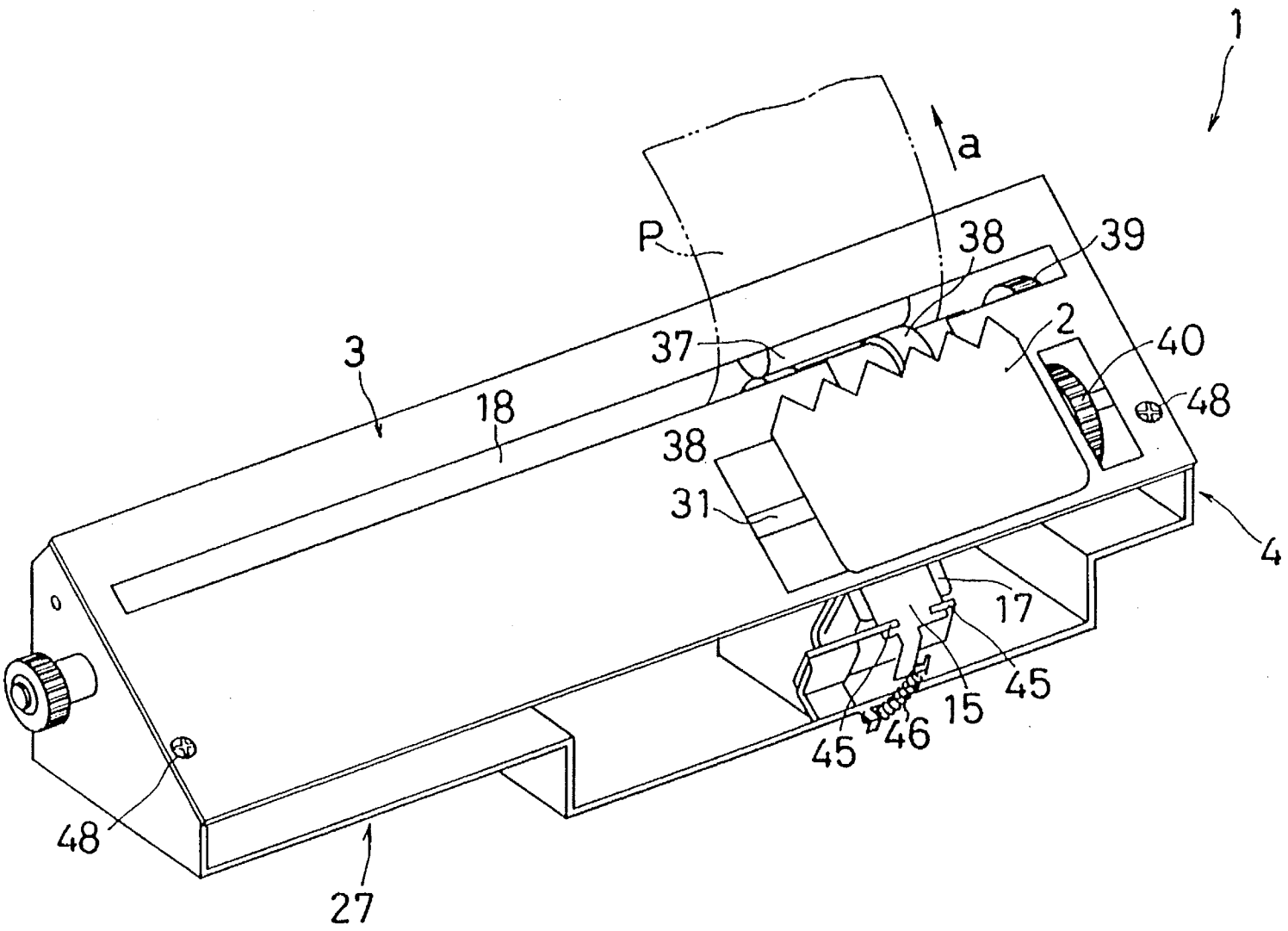
FIG. 4 is a perspective view showing the embodiment of the cutter device of the present invention.
Figure 5:
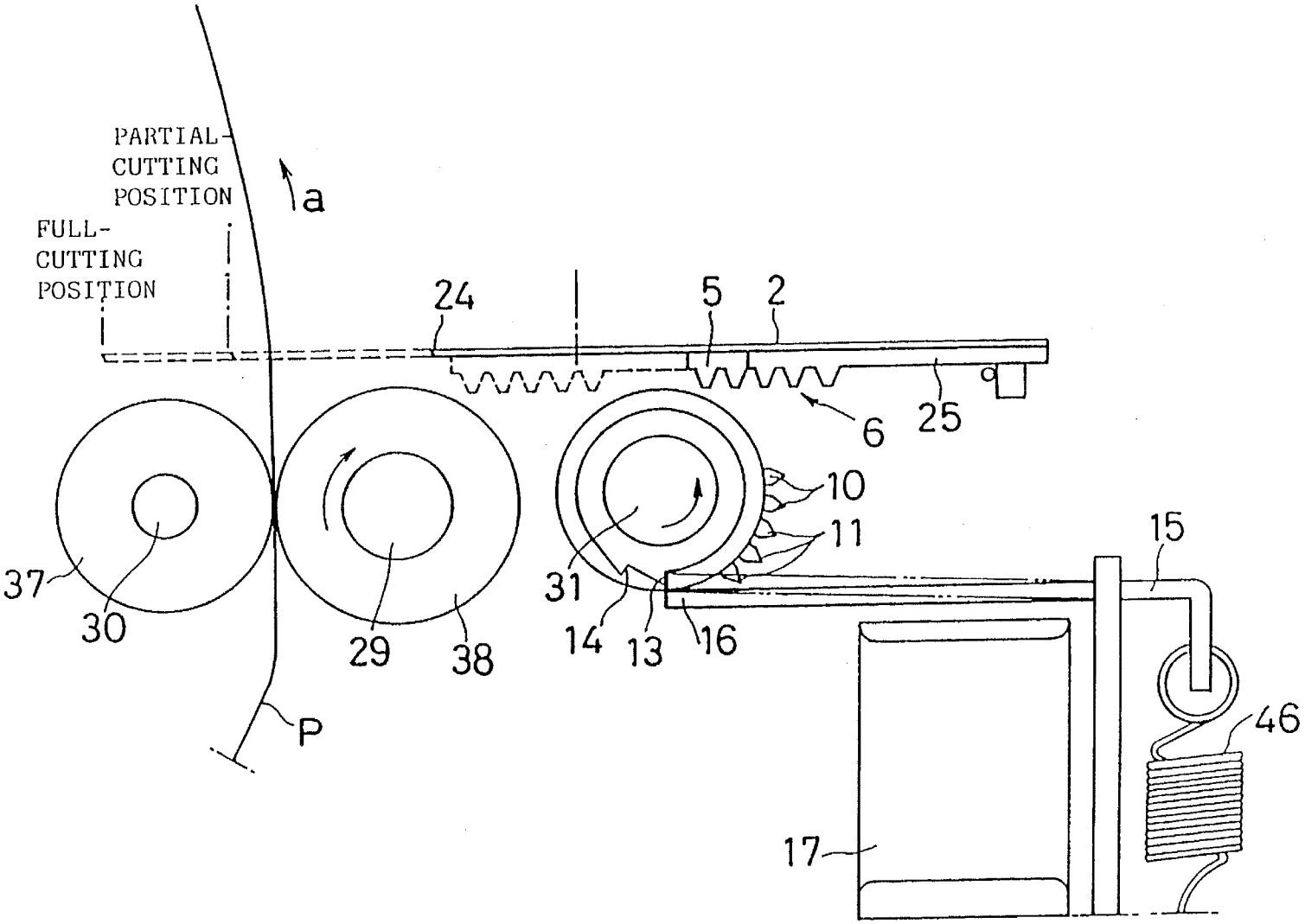
FIG. 5 is a side view showing an essential part of the embodiment of the cutter device of the present invention.

The paper feed rollers 38 and a gear 39 are integrally mounted to the rotation transmitting shaft 29. Further, a friction roller 37 is rotatably mounted on the roller shaft 30 to contact the paper feed rollers 38. As shown in FIG. 5, a paper P is held between the paper feed rollers 38 and the friction roller 37 to be fed in a paper feeding direction shown by the solid-line arrow a in FIG. 4.

As shown in FIG. 1, a gear 40 is integrally mounted on the rotary shaft 31 to mesh with the gear 39 mounted on the rotation transmitting shaft 29. Thus, the torque of the rotation transmitting shaft 29 is transmitted through the gear 39 and the gear 40 to the rotary shaft 31, thereby rotating the rotary shaft 31 in a direction shown by the arrow c in FIG. 1.

Figure 3:
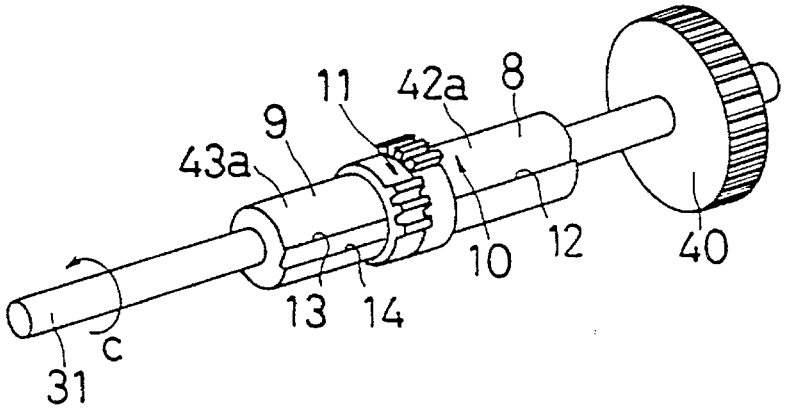
FIG. 3 is a perspective view showing an enlarged essential part of FIG. 1.
Figure 15:
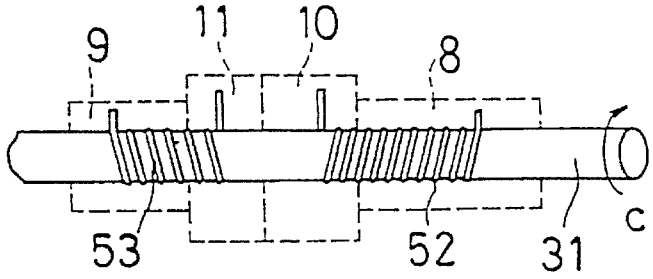
FIG. 15 is a view showing engaging relationships between the ratchet wheel and the pinion in the first pair and a rotary shaft, and between the ratchet wheel and the pinion in the second pair and the rotary shaft.

The first clutch 49 to control the rotation of the first pinion 10 includes a first ratchet wheel 8 shown in FIG. 3, a first spring clutch 52 shown in FIG. 15, and a switching engaging portion **16*a* shown in FIG. 1. The first ratchet wheel 8 is mounted on the rotary shaft 31 for the partial-cutting/the full-cutting first half movement. The first spring clutch 52** connects the first pinion 10 with the first ratchet wheel 8, and transmits power from the rotary shaft 31 to the first ratchet wheel 8 only in a direction shown by the arrow c to move the cutter 2 toward the side of the paper ejecting port 18. Further, the switching engaging portion 16*a* is urged toward the side of the first ratchet wheel 8 to engage an initial position setting stopper 12 extending from a peripheral surface of the first ratchet wheel 8.

The second clutch 50 to control the rotation of the second pinion 11 includes a second ratchet wheel 9 for the full-cutting latter half movement as shown in FIG. 3, a second spring clutch 53 shown in FIG. 15, and a switching engaging portion 16*b* shown in FIG. 1. The second spring clutch 53 connects the second pinion 11 with the second ratchet wheel 9, and transmits power from the rotary shaft 31 to the second ratchet wheel 9 only in a direction to move the cutter 2 toward the side of the paper ejecting port 18 shown in FIG. 1. Further, the switching engaging portion 16*b* is urged toward the side of the second ratchet wheel 9 to engage or be disengaged from an initial position setting stopper 13 and a second stop position setting stopper 14 which extend from a peripheral surface of the second ratchet wheel 9.

The switching engaging portion 16*a* and the switching engaging portion 16*b* are respectively mounted at two distal end branches of an armature 15.

As shown in FIG. 15, the first and second spring clutches 52 and 53 are independently mounted on the rotary shaft 31. The respective spring clutches 52 and 53 can serve as a one-way clutch to which power is transmitted when the first ratchet wheel 8 and the second ratchet wheel 9 are rotated in a direction to move the cutter 2 toward the side of the paper ejecting port 18 shown in FIG. 1, i.e., in a forward direction. Connecting ends are formed at both ends of the respective spring clutches 52 and 53 which have smaller diameters than a diameter of the rotary shaft 31 in a free state before assembly. The spring clutches 52, 53 are mounted about the rotary shaft 31 so as to be rotated together with the rotary shaft 31. If the rotary shaft 31 is rotated in a direction opposed to a wound direction of the spring clutch when one connecting end is fixed, the spring clutch is loosened to rotate only the rotary shaft 31.

As shown in FIG. 3, the first pinion 10 has teeth whose number is sufficient to engage the first rack 5 provided for the cutter guide plate 25 so as to carry out only the partial-cutting operation. The second pinion 11 has teeth whose number is given by subtracting the number of teeth of the first pinion 10 from the number of teeth required to engage the second rack 6 of the cutter guide plate 25 so as to carry out the full-cutting operation.

In addition, as shown in FIG. 3, the initial position setting stopper 12 extends from a peripheral surface 42*a* of the first ratchet wheel 8 to set an initial position of the first pinion 10. The initial position setting stopper 13 extends from a peripheral surface 43*a* of the second ratchet wheel 9 to set an initial position of the second pinion 11, and the second stop position setting stopper 14 also extends therefrom on a subsequent stage of the initial position setting stopper 13 in order to temporarily anchor the rotation of the second pinion 11.

The spring clutches 52 and 53 are mounted in the first ratchet wheel 8 and the second ratchet wheel 9, and are connected to the rotary shaft 31 in the following two directions in view of the torque in the direction of the arrow c shown in FIGS. 1 and 3. In one direction, when the first ratchet wheel 8 is fixedly anchored, the spring clutch on the side of the first ratchet wheel 8 is loosened to interrupt the connection between the rotary shaft 31 and the first ratchet wheel 8. In the other direction, when the second ratchet wheel 9 is fixedly anchored, the spring clutch on the side of the second ratchet wheel 9 is loosened to interrupt the connection between the rotary shaft 31 and the second ratchet wheel 9.

As shown in FIGS. 1 and 5, under the first ratchet wheel 8 and the second ratchet wheel 9, the armature 15 and the armature driving solenoid 17 are disposed in the concave portion 28 of the bottom plate portion 27 in the cutter device body 4. The armature 15 is provided with the switching engaging portions 16*a* and 16*b* which are urged toward the side of the respective stoppers 12, 13, and 14 for engagement. The armature driving solenoid 17 moves the armature 15 apart from the respective stoppers 12, 13, and 14.

The armature 15 has two distal end branches serving as the switching engaging portions 16*a* and 16*b*, and is swingably supported by supporting claws 45 from the lateral sides at a position closer to a main end of the armature 15. Further, one end of a coil spring 46 is connected with the main end of the armature 15, and the other end of the coil spring 46 is connected with a member positioned under the main end of the armature 15. Thus, the armature 15 is urged by the coil spring 46 with the supporting claws 45 as swing supporting points so as to contact the respective peripheral surfaces 42*a* and 43*a* of the first ratchet wheel 8 and the second ratchet wheel 9.

On the side of a lower surface of the armature 15, there is disposed the armature driving solenoid 17 which is excited to attract the armature 15 so as to move the armature 15 apart from the respective stoppers 12, 13, and 14.

The cutter mounting plate 3 is mounted on the cutter device body 1 in the following manner. Both side edges of the back surface of the cutter mounting plate 3 are brought into contact with the end surfaces of the oblique sides of both the side plates 26*a* and 26*b* of the cutter device body 1. Subsequently, screws 48, 48 pass through the mounting holes 19, 19 in the cutter mounting plate 3, and are thereafter screwed into the tap holes 34*a* and 34*b* which are provided in expanded portions 33*a* and 33*b* of both the side plates 26*a* and 26*b*. As a result, the cutter mounting plate 3 can be mounted as shown in FIG. 4. The first rack 5 and the second rack 6 provided for the cutter guide plate 25 are disposed to respectively correspond to rotated and moved positions of the first pinion 10 and the second pinion 11.

A description will now be given of the operation of the cutter device 1.

In FIG. 1, when the driving motor of the unillustrated printer body is driven, the torque is transmitted to the gear 36 through the train of gears to rotate the rotation transmitting shaft 29 in a direction of the arrow b. As shown in FIG. 5, the paper P is held between the paper feed rollers 38 and the friction roller 37 to be fed in the paper feeding direction. Concurrently, as shown in FIG. 1, the torque in the direction of the arrow c is transmitted to the rotary shaft 31 through the gear 39 and the gear 40.

When the armature driving solenoid 17 is not operated, the switching engaging portions 16*a* and 16*b* of the armature 15 are respectively urged by the coil spring 46 toward the side of the first ratchet wheel 8 and the second ratchet wheel 9 to engage the initial position setting stopper 12 and the initial position setting stopper 13 of the first ratchet wheel 8 and the second ratchet wheel 9. Consequently, as shown by the solid lines in FIGS. 6(*a*) and 6(*b*), the first pinion 10 and the second pinion 11 can be set at initial positions.

In this case, the first ratchet wheel 8 and the second ratchet wheel 9 mounted on the rotary shaft 31 are stopped by the switching engaging portions 16*a* and 16*b* of the armature 15 respectively anchoring the initial position setting stopper 12 and the initial position setting stopper 13 extending from the ratchet wheels 8 and 9. That is, both the spring clutches to connect the rotary shaft 31 with the respective ratchet wheels 8 and 9 are loosened to interrupt the connection therebetween. Hence, only the rotary shaft 31 can be rotated in the direction of the arrow c to keep the set initial positions in the first pinion 10 and the second pinion 11.

The armature driving solenoid 17 is driven for the switching between the partial-cutting operation and the full-cutting operation, and has a short excited operation time. When the armature driving solenoid 17 is operated, the armature 15 is attracted by the solenoid 17 against urging force of the coil spring 46, and is swung with the supporting claws 45, 45 as the swing supporting points. Subsequently, the distal ends of the armature 15, i.e., the switching engaging portions 16*a* and 16*b* are disengaged from the respective initial position setting stoppers 12 and 13. This can release the switching engaging portions 16*a* and 16*b* of the armature 15 anchoring the first ratchet wheel 8 and the second ratchet wheel 9. Then, both the spring clutches of the ratchet wheels 8 and 9 are tightened to connect the rotary shaft 31 with the ratchet wheels 8 and 9. As a result, both the first ratchet wheel 8 and the second ratchet wheel 9 can be rotated.

Figure 7:
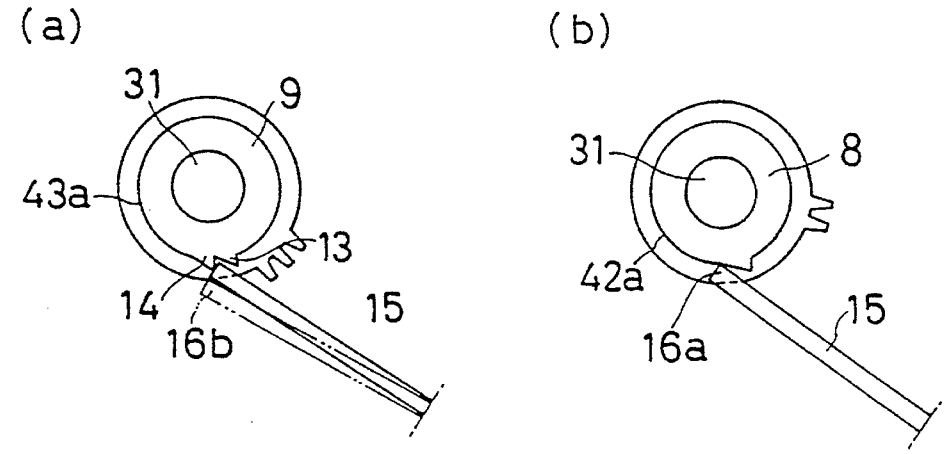
FIG. 7 is side views showing the ratchet wheel and the pinion in the first pair, and the ratchet wheel and the pinion in the second pair when starting to rotate.

Thereafter, when the operation of the armature driving solenoid 17 is stopped, the switching engaging portions 16*a* and 16*b* of the armature 15 are urged toward the sides of the first ratchet wheel 8 and the second ratchet wheel 9 to contact the peripheral surfaces 42*a* and 43*a* of the first ratchet wheel 8 and the second ratchet wheel 9 as shown in FIGS. 7(*a*) and 7(*b*).

The subsequent operation depends upon the partial-cutting operation or the full-cutting operation. A description will be given of the partial-cutting operation.

While the first ratchet wheel 8 and the second ratchet wheel 9 are concurrently rotated, the switching engaging portion 16*b* of the armature 15 engages the second stop position setting stopper 14 extending from the peripheral surface 43*a* of the second ratchet wheel 9 as shown in FIG. 7(*a*). Hence, the spring clutch on the side of the second ratchet wheel 9 is loosened to interrupt the connection so that the second ratchet wheel 9 is temporarily prevented from rotating. On the other hand, the first ratchet wheel 8 is not rotated to a position where the initial position setting stopper 12 can engage the switching engaging portion 16*a* of the armature 15. Accordingly, rotation of the first ratchet wheel 8 is held with the switching engaging portion 16*a* of the armature 15 contacting the cam surface 42*a* of the first ratchet wheel 8.

Figure 8:
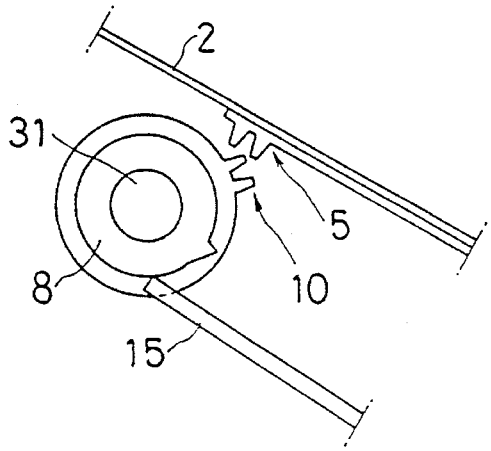
FIG. 8 is a side view showing an engaging relationship between the pinion in the first pair and a rack in the first pair.
Figure 9:
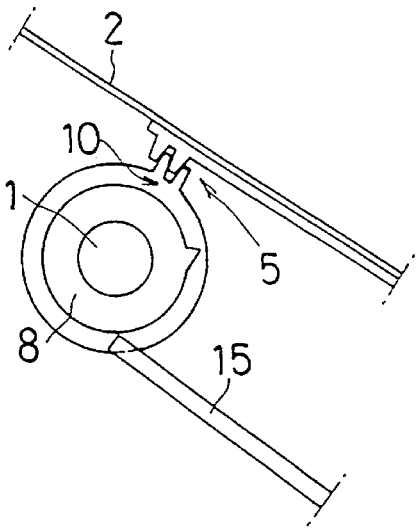
FIG. 9 is a side view showing an engaging relationship between the pinion in the first pair and the rack in the first pair.

On the other hand, the teeth of the first rack 5 is provided on the cutter 2 to be ahead of the teeth of the second rack 6 in the direction of movement of the cutter 2. Therefore, as shown in FIGS. 8 and 9, the first pinion 10 initially engages the first rack 5 of the cutter 2 to push out the cutter 2 ahead of its predetermined position according to the rotation of the first ratchet wheel 8 so as to forward move the cutter 2 to a partial-cutting position shown in FIG. 5. At this time, the paper P can be partially cut.

Figure 10:
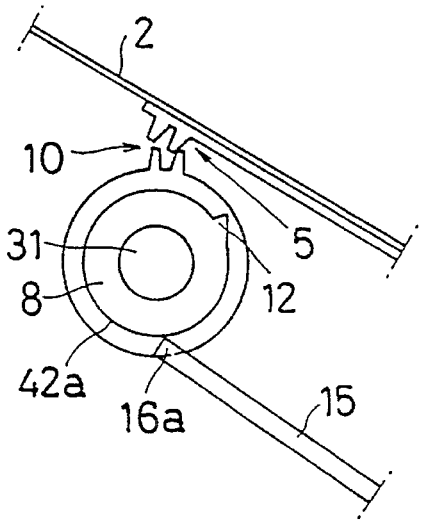
FIG. 10 is a side view showing an engaging relationship between the pinion in the first pair and the rack in the first pair.

When the first ratchet wheel 8 is further rotated after the partial-cutting operation of the paper P, the engagement between the first pinion 10 and the first rack 5 is released as shown in FIG. 10, and the cutter 2 can return to the predetermined position by urging force of the torsion coil spring 23.

Figure 11:
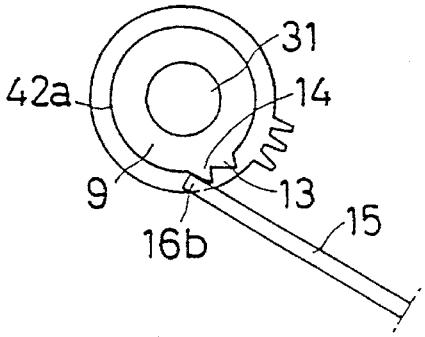
FIG. 11 is a side view showing an engaging relationship between the pinion in the second pair and a switching engaging portion.
Figure 16:
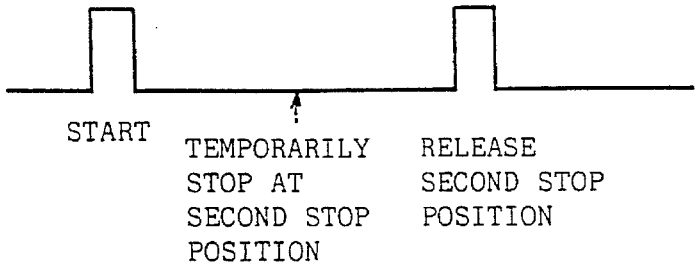
FIG. 16 is a timing chart showing conducting timing of a solenoid during partial-cutting operation.

In case of the partial-cutting operation, as shown in a timing chart of FIG. 16, the rotation of the second ratchet wheel 9 is temporarily stopped so as not to engage the second pinion 11 with the second rack 6 provided for the cutter 2. Subsequently, when the cutter 2 returns to the predetermined position after the partial-cutting operation of the paper P, the armature driving solenoid 17 is operated to release the engagement between the second stop position setting stopper 14 of the second ratchet wheel 9 and the switching engaging portion 16*b* of the armature 15 as shown by two-dot chain line in FIG. 7(*a*) and FIG. 16. Thereafter, the urging force of the coil spring 46 keeps the switching engaging portions 16*a* and 16*b* of the armature in contact with the peripheral surface 43*a* of the second ratchet wheel 9 as shown in FIG. 11. The spring clutch on the side of the second ratchet wheel 9 is connected with the rotary shaft 31 to rotate the second ratchet wheel 9 again. During the operation, the first ratchet wheel 8 also keeps rotating.

Since the teeth of the second rack 6 is disposed behind the teeth of the first rack 5, the second pinion 11 never engages the second rack 6 provided for the cutter 2 when the cutter 2 is at the predetermined position.

Both the first ratchet wheel 8 and the second ratchet wheel 9 are rotated once again with the switching engaging portions 16*a* and 16*b* of the armature 15 contacting the respective peripheral surfaces 42*a* and 43*a*. The switching engaging portions 16*a* and 16*b* of the armature 15 engage the initial position setting stopper 12 and the initial position setting stopper 13 of both the first ratchet wheel 8 and the second ratchet wheel 9. Accordingly, the first pinion 10 of the first ratchet wheel 8 and the second pinion 11 of the second ratchet wheel 9 are respectively set at the initial positions, and the spring clutches of the respective ratchet wheels 8 and 9 are loosened. This interrupts the connection between the rotary shaft 31 and the respective ratchet wheels 8 and 9, and the rotation of the ratchet wheels 8 and 9 is stopped to return to initial states shown in FIGS. 6(*a*) and 6(*b*).

Figure 6:
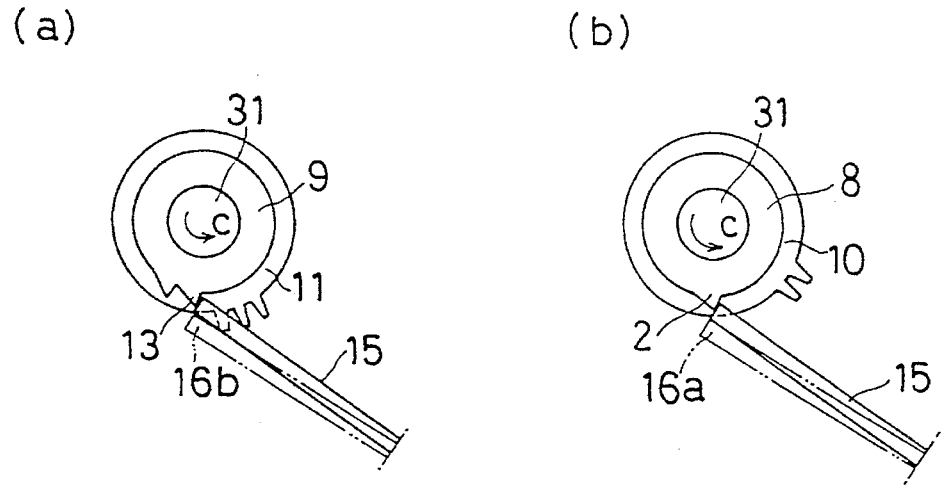
FIG. 6 is side views showing initial positions of a ratchet wheel and a pinion in a first pair, and a ratchet wheel and a pinion in a second pair.
Figure 17:
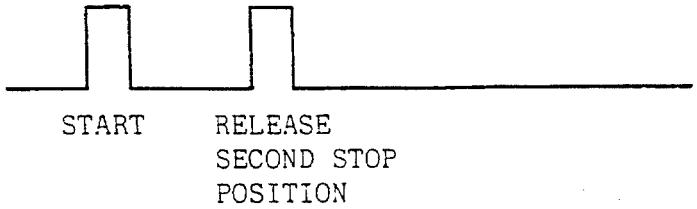
FIG. 17 is a timing chart showing conducting timing of the solenoid during full-cutting operation.

Next, a description will be given of the full-cutting operation. After the first ratchet wheel 8 and the second ratchet wheel 9 are concurrently rotated from their initial positions as shown in FIGS. 6(*a*) and 6(*b*), the armature driving solenoid 17 is operated again according to predetermined timing as shown in FIG. 17. This can prevent the switching engaging portion 16*b* of the armature 15 from engaging the second stop position setting stopper 14 of the peripheral surface 43*a* of the second ratchet wheel 9.

Figure 12:
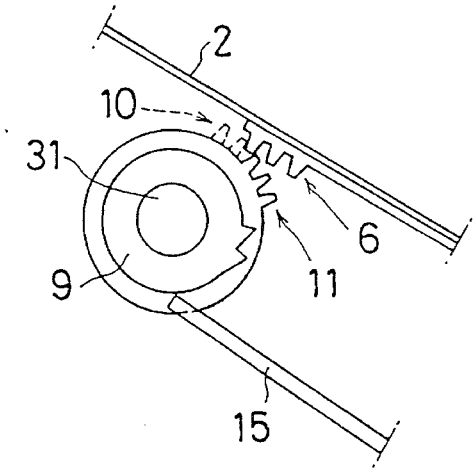
FIG. 12 is a side view showing an engaging relationship between the pinion in the second pair and a rack in the second pair.
Figure 13:
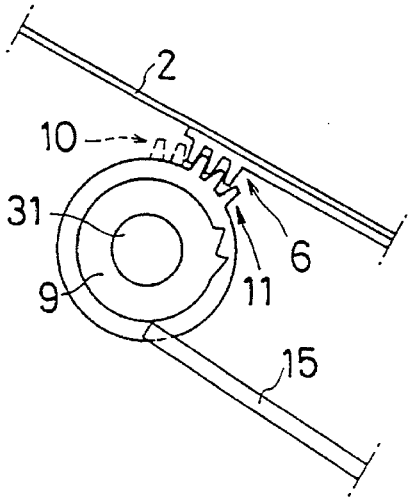
FIG. 13 is a side view showing an engaging relationship between the pinion in the second pair and the rack in the second pair.

After the concurrent rotation of the first ratchet wheel 8 and the second ratchet wheel 9, as shown in FIGS. 8 and 9, the first pinion 10 initially engages the first rack 5 provided for the cutter 2 to push out the cutter 2 ahead of the predetermined position according to the rotation of the first ratchet wheel 8. Subsequently, as shown in FIGS. 12 and 13, the second pinion 11 engages the second rack 6 provided for the cutter 2.

After both the ratchet wheels 8 and 9 are further rotated to forward move the cutter 2 to a partial-cutting position shown in FIG. 5, the engagement between the first pinion 10 and the first rack 5 is released as shown in FIG. 10. Thereafter, as shown in FIG. 13, the second pinion 11 still engages the second rack 6 according to the rotation of the second ratchet wheel 9 so as to push out the cutter 2 further ahead of the position to a full-cutting position shown in FIG. 5. At this time, the paper P can be fully cut.

Figure 14:
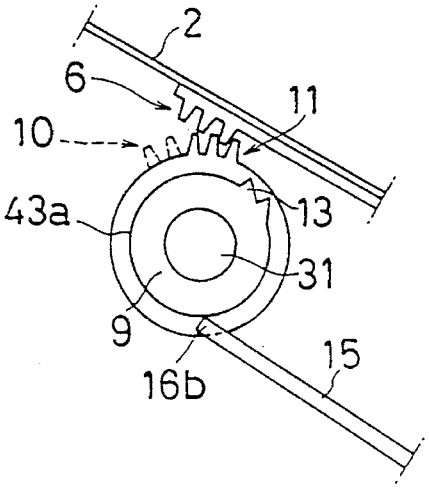
FIG. 14 is a side view showing an engaging relationship between the pinion in the second pair and the rack in the second pair.

When both the ratchet wheels 8 and 9 are further rotated after the full-cutting operation of the paper P, the engagement between the second pinion 11 and the second rack 6 is released as shown in FIG. 14, and the cutter 2 can return to the predetermined position by the urging force of the torsion coil spring 23.

The subsequent operation is identical with that in case of the partial-cutting operation. That is, both the first ratchet wheel 8 and the second ratchet wheel 9 are rotated with the switching engaging portions 16*a* and 16*b* of the armature 15 contacting the peripheral surfaces 42*a* and 43*a* thereof. The switching engaging portions 16*a* and 16*b* of the armature 15 engage the initial position setting stopper 12 and the initial position setting stopper 13 of both the first ratchet wheel 8 and the second ratchet wheel 9. Accordingly, the first pinion 10 and the second pinion 11 are respectively set at the initial positions, and the spring clutches of the respective ratchet wheels 8 and 9 are loosened. This interrupts the connection between the rotary shaft 31 and the respective cams. Further, the rotation of the ratchet wheels 8 and 9 is stopped so that the ratchet wheels 8 and 9 can return to initial states.

As is apparent from the above description of the embodiment of the present invention, according to the cutter device of the present invention, it is possible to drive the cutter without a special cutter motor to drive the cutter as in the prior art. It is also possible to control both the partial-cutting operation and the full-cutting operation by one solenoid, reduce production cost, and realize the space saving.

What is claimed is:

1. A cutter device of a printer, to carry out full-cutting operation and partial-cutting operation by changing moving strokes of a cutter with respect to a paper, comprising:

two pairs of assemblies mounted in parallel with each other in a direction of movement of the cutter, each assembly including a rack, a pinion, and a clutch to control rotation of the pinion;

one solenoid; and the pinion in the first pair including teeth whose number is sufficient to carry out only the partial-cutting operation, the pinion in the second pair including teeth whose number is given by subtracting the number of teeth of the first pinion from the number of teeth required to carry out the full-cutting operation, and the pinion in the first pair and the pinion in the second pair being coaxially disposed;

wherein, in the partial-cutting operation, the cutter is moved by engaging the rack in the first pair with the pinion in the first pair rotated by power from the clutch in the first pair;

in the full-cutting operation, the cutter is moved by engaging the pinions in the first and second pairs concurrently rotated through power from the clutches in the first and second pairs with the racks in the first and second pairs, the cutter being disposed to carry out first half movement for the full-cutting operation by the pinion in the first pair and being disposed to carry out latter half movement for the full-cutting operation by the pinion in the second pair, the clutch in the first pair having a first stop position to stop the pinion in the first pair at its initial position, and the clutch in the second pair having two of a first stop position to stop the pinion in the second pair at its initial position and a second stop position set immediately after the first stop position; and the solenoid releases the respective stop positions of the clutches in the first and second pairs, and carries out two operations, i.e., both the full-cutting operation by concurrently releasing the initial position of the pinion in the first pair and the initial position and the second stop position of the pinion in the second pair so as to rotate the pinions in the first and second pairs at the same time, and the partial-cutting operation by releasing the initial positions of the pinions in the first and second pairs and subsequently stopping the pinion in the second pair at the second stop position.

* * * * *